US006181249B1

(12) United States Patent
Maitin et al.

(10) Patent No.: US 6,181,249 B1
(45) Date of Patent: Jan. 30, 2001

(54) COIL DRIVING CIRCUIT FOR EAS MARKER DEACTIVATION DEVICE

(75) Inventors: Steven R. Maitin, Lake Worth; Ronald B. Easter, Parkland, both of FL (US)

(73) Assignee: Sensormatic Electronics Corporation, Boca Raton, FL (US)

( * ) Notice: Under 35 U.S.C. 154(b), the term of this patent shall be extended for 0 days.

(21) Appl. No.: 09/226,868

(22) Filed: Jan. 7, 1999

(51) Int. Cl.[7] ..... G08B 13/14

(52) U.S. Cl. ..... 340/572.3; 340/572.6; 340/551

(58) Field of Search ..... 340/572.3, 572.6, 340/572.1, 551, 572.2, 143

(56) References Cited

U.S. PATENT DOCUMENTS 5,493,275 * 2/1996 Easter ..... 340/551
5,495,230 * 2/1996 Lian ..... 340/551
5,841,348 * 11/1998 Herzer ..... 340/551
5,973,606 * 10/1999 Maitin et al. ..... 340/551
5,999,098 * 12/1999 Lian et al. ..... 340/572.6

* cited by examiner

*Primary Examiner*—Jeffery A. Hofsass
*Assistant Examiner*—John Tweel, Jr.
(74) *Attorney, Agent, or Firm*—Robin, Blecker & Daley

(57) ABSTRACT

A device for deactivating a magnetomechanical electronic article surveillance (EAS) marker includes a deactivation coil array and a coil driving circuit. The coil driving circuit repetitively energizes the deactivation coil array according to a predetermined timing to generate a magnetic field for deactivating the EAS marker. The driving circuit includes at least one storage capacitor, circuitry for charging the at least one storage capacitor and a switching circuit for selectively forming a resonant circuit which includes the storage capacitor and at least some of the coils of the coil array to generate a ring-down signal in the coils. A timing circuit controls the switching circuit to generate the ring-down signal repetitively at the predetermined timing.

13 Claims, 7 Drawing Sheets

COIL DRIVE CIRCUIT
3B
3B
214
206
202
T1
140VAC.0.03A
140VAC.0.45A
140VAC.0.25A
Z_CROSS
216
204
50/60Hz
XF RMR
115V
220V
1A,2
1B,2,A
1,2A
VSELECT
S1
212
SURGE
GUARD
RT1
210
V1
VAR
5x20 .5A 36 FUSE
F1
ON/OFF
SWITCH
S2
PI
208
200
AC IN
110/220
50/60Hz
C8
1u
R24
C7
1k
4.7u
25V
DISABLE
TP7
TP
U28
DISC
CONT
THRE
TRIG
RST
OUT
NE566
50 USEC PULSE
R7
464
R9
10k
C11
.1u
C10
.1u
236
C9
.01u
TP6
TP
VCC
C6
.01u
C5
.01u
U2A
DISC
CONT
THRE
TRIG
VCC
RST
OUT
GND
NE566
10Hz
OSCILLATOR
C12
1u
R8
14.7k
1%
R11
64.9k
1%

COIL DRIVING CIRCUIT FOR EAS MARKER DEACTIVATION DEVICE

FIELD OF THE INVENTION

This invention relates generally to electronic article surveillance (EAS) and pertains more particularly to so-called "deactivators" for rendering EAS markers inactive.

BACKGROUND OF THE INVENTION

It has been customary in the electronic article surveillance industry to apply EAS markers to articles of merchandise. Detection equipment is positioned at store exits to detect attempts to remove active markers from the store premises, and to generate an alarm in such cases. When a customer presents an article for payment at a checkout counter, a checkout clerk either removes the marker from the article, or deactivates the marker by using a deactivation device provided to deactivate the marker.

Known deactivation devices include one or more coils that are energizable to generate a magnetic field of sufficient amplitude to render the marker inactive. One well known type of marker (disclosed in U.S. Pat. No. 4,510,489) is known as a "magnetomechanical" marker. Magnetomechanical markers include an active element and a bias element. When the bias element is magnetized in a certain manner, the resulting bias magnetic field applied to the active element causes the active element to be mechanically resonant at a predetermined frequency upon exposure to an interrogation signal which alternates at the predetermined frequency. The detection equipment used with this type of marker generates the interrogation signal and then detects the resonance of the marker induced by the interrogation signal. According to one known technique for deactivating magnetomechanical markers, the bias element is degaussed by exposing the bias element to an alternating magnetic field that has an initial magnitude that is greater than the coercivity of the bias element, and then decays to zero. After the bias element is degaussed, the marker's resonant frequency is substantially shifted from the predetermined interrogation signal frequency, and the marker's response to the interrogation signal is at too low an amplitude for detection by the detecting apparatus.

Prior application Ser. No. 08/801,489 (which is commonly assigned with the present application) discloses a marker deactivation device in which conductive coils are driven with a constant amplitude sinusoidal signal to generate an alternating magnetic field at and for some distance above a top surface of the deactivation device. A magnetomechanical marker swept over the top of the device is exposed to a decaying-amplitude alternating field as the marker exits the region above the deactivation device, resulting in degaussing of the marker bias element and deactivation of the marker.

In another type of deactivation device, such as is disclosed in U.S. Pat. No. 5,493,275 (which has a common inventor and common assignee with the present application), the deactivation device includes a circuit for detecting the presence of a marker to be deactivated. When the presence of the marker is detected, a coil drive circuit is triggered to generate a decaying-amplitude alternating signal which is applied to a deactivation coil. Because the driving signal applied to the coil in the latter type of device is itself a decaying signal, it is not necessary to sweep the marker past the deactivation device, and effective deactivation is accomplished even if the device is simply placed on top of the deactivation device.

It is also known to trigger the coil drive circuit in response to a button or switch actuated by the checkout clerk.

Although the types of deactivation devices described above may be satisfactorily employed for their intended purpose, it would be desirable to provide a deactivation device for magnetomechanical markers which does not require sweeping the marker past the deactivation device or detecting the presence of the deactivation device or triggering by a human operator.

OBJECTS AND SUMMARY OF THE INVENTION

It is an object of the present invention to provide an energizing circuit for an EAS marker deactivation device wherein the circuit operates without user input and is not dependent upon marker detection for reliable operation.

It is a further object of the invention to provide an energizing circuit which makes the deactivation device convenient to use.

According to an aspect of the invention, there is provided an apparatus for deactivating an electronic article surveillance marker, the apparatus including at least one deactivation coil and a driving circuit for repetitively energizing the at least one deactivation coil according to a predetermined timing to generate a magnetic field for deactivating the marker, wherein the driving circuit includes at least one storage capacitor, circuitry for charging the at least one storage capacitor, a ring-down circuit for selectively forming a resonant circuit which includes the at least one deactivation coil and the at least one storage capacitor to generate a ring-down signal in the at least one deactivation coil, and a timing circuit for controlling the ring-down circuit to generate the ring-down signal repetitively at the predetermined timing. The apparatus provided in accordance with the invention operates in an energy-efficient manner, does not require triggering from a marker detection circuit, or from a human operator, and does not require the operator to sweep a marker past the device in order to obtain reliable deactivation of magnetomechanical EAS markers.

The foregoing, and other objects, features and advantages of the invention will be further understood from the following detailed description of preferred embodiments and from the drawings, wherein like reference numerals identify like components and parts throughout.

DESCRIPTION OF PREFERRED EMBODIMENTS

A preferred embodiment of the invention will now be described, initially with reference to FIG. 1.

Figure 1:
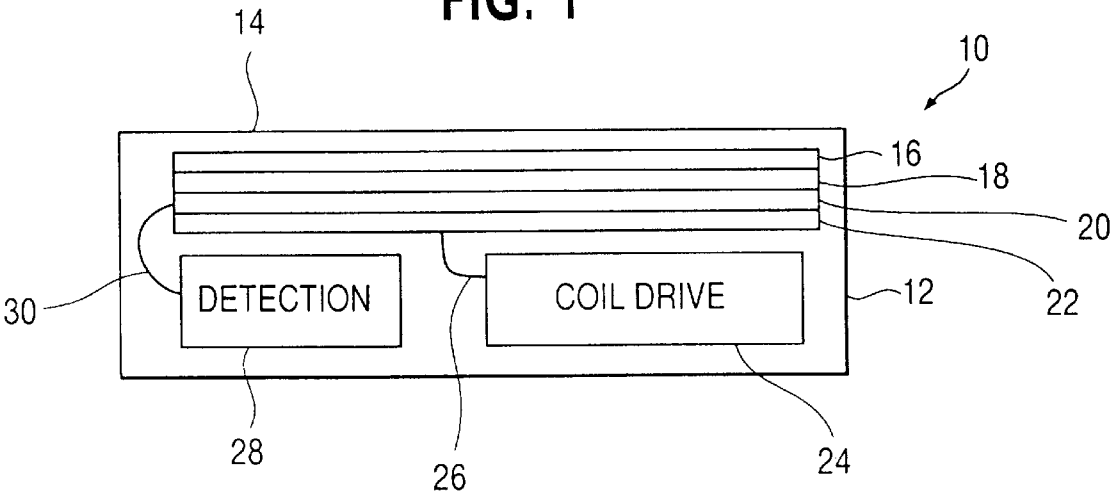
FIG. 1 is a schematic vertical sectional view of a marker deactivation device provided in accordance with the invention.

FIG. 1 is a schematic vertical sectional view of a marker deactivation device 10 provided in accordance with the invention. The deactivation device 10 includes a housing 12 which may be formed, in accordance with conventional practice, of molded plastic, and includes a substantially flat, planar top surface 14 at which EAS markers are presented for deactivation. Positioned within the housing 12 just below the top surface 14 is a vertically stacked arrangement of substrates 16, 18, 20, 22. As will be seen, each of the substrates has formed thereon a coil array, the respective coil arrays being interconnected to form a composite coil array which is driven to generate a deactivation magnetic field at, and for some distance above, the top surface 14.

Also contained within the housing 12 is a coil driving circuit 24 which is connected via cable 26 to the aforementioned composite coil array, which is not shown separately in FIG. 1 from the substrates 16, 18, 20 and 22.

Another component located within the housing 12 is a detection circuit 28 connected via a cable 30 to a transceiver coil which is not separately shown in FIG. 1 but will be discussed below.

It is to be noted that, for ease of illustration, the vertical dimension of FIG. 1 has been exaggerated relative to the horizontal dimension. Preferably the housing 12 has a conventional low profile configuration like known "deactivation pad" devices.

Although coil driving circuit 24 and detection circuit 28 are shown as being positioned in the housing 12 below the substrates 16–22, it is contemplated to position one or both of these devices horizontally alongside the substrates and/or in a housing separate from the housing 12.

FIGS. 2A–2D are, respectively, plan views of the four substrates 16, 18, 20 and 22, showing conductive traces provided on the substrates to form coil arrays thereon. Each of the coil arrays is a square, six-by-six array of spiral coils, each coil consisting of substantially three turns. The coil arrays respectively provided on each of the four substrates are positioned vertically in registration with each other, so that each of the coils on top substrate 16 (illustrated in FIG. 2A) has a corresponding coil positioned directly below it on each of the substrates 18, 20 and 22. As will be seen, vertical connections provided between the substrates join each stack of four spiral coils so as to form therefrom a composite coil. As will also be seen, the thirty-six resulting composite coils are connected so as to provide two series connections of eighteen composite coils each, connected in parallel to the coil driving circuit 24.

Figure 2A:
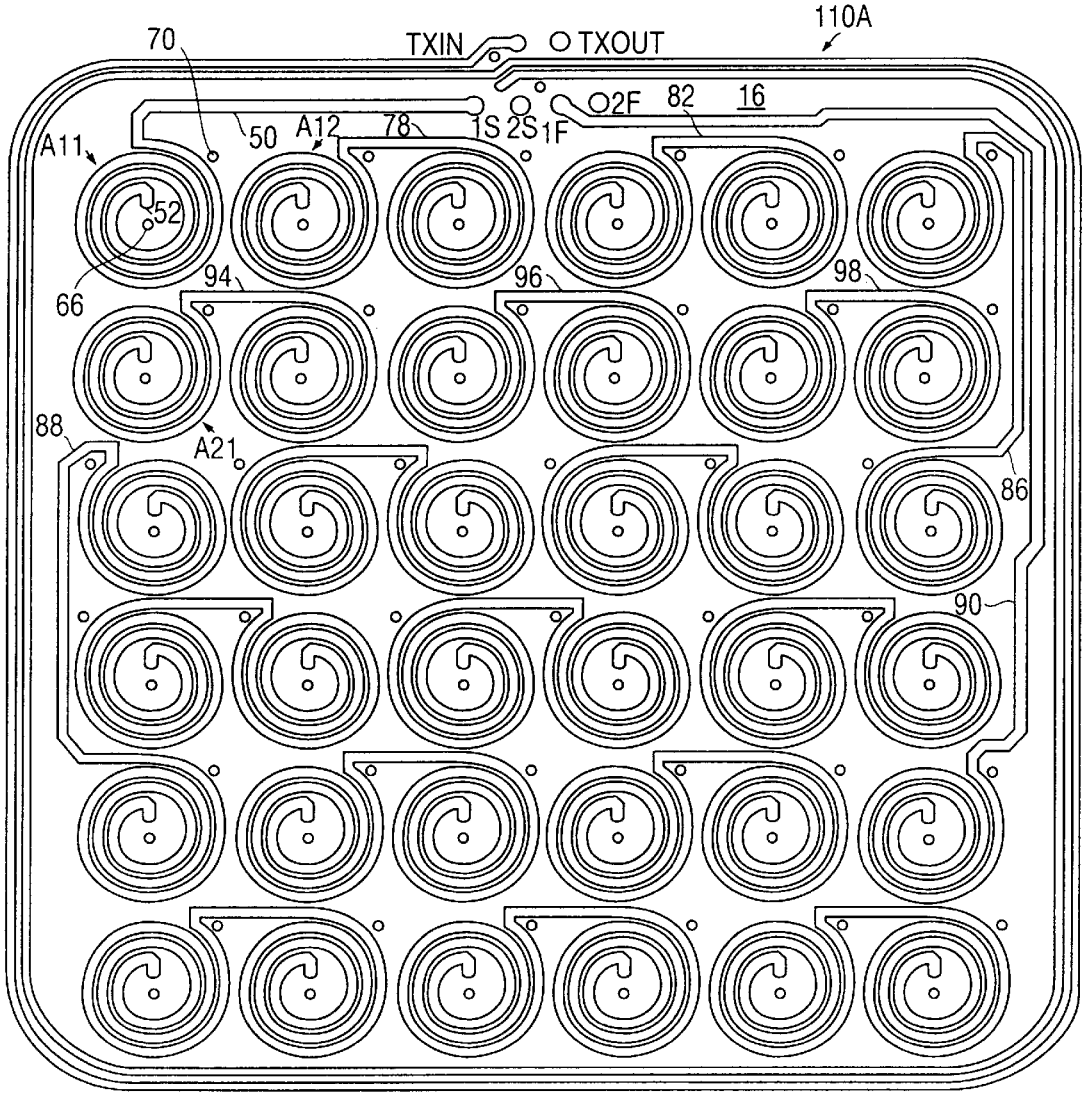
FIGS. 2A–2D are respective plan views of deactivation coil arrays included in the deactivation device of FIG. 1.
Figure 2B:
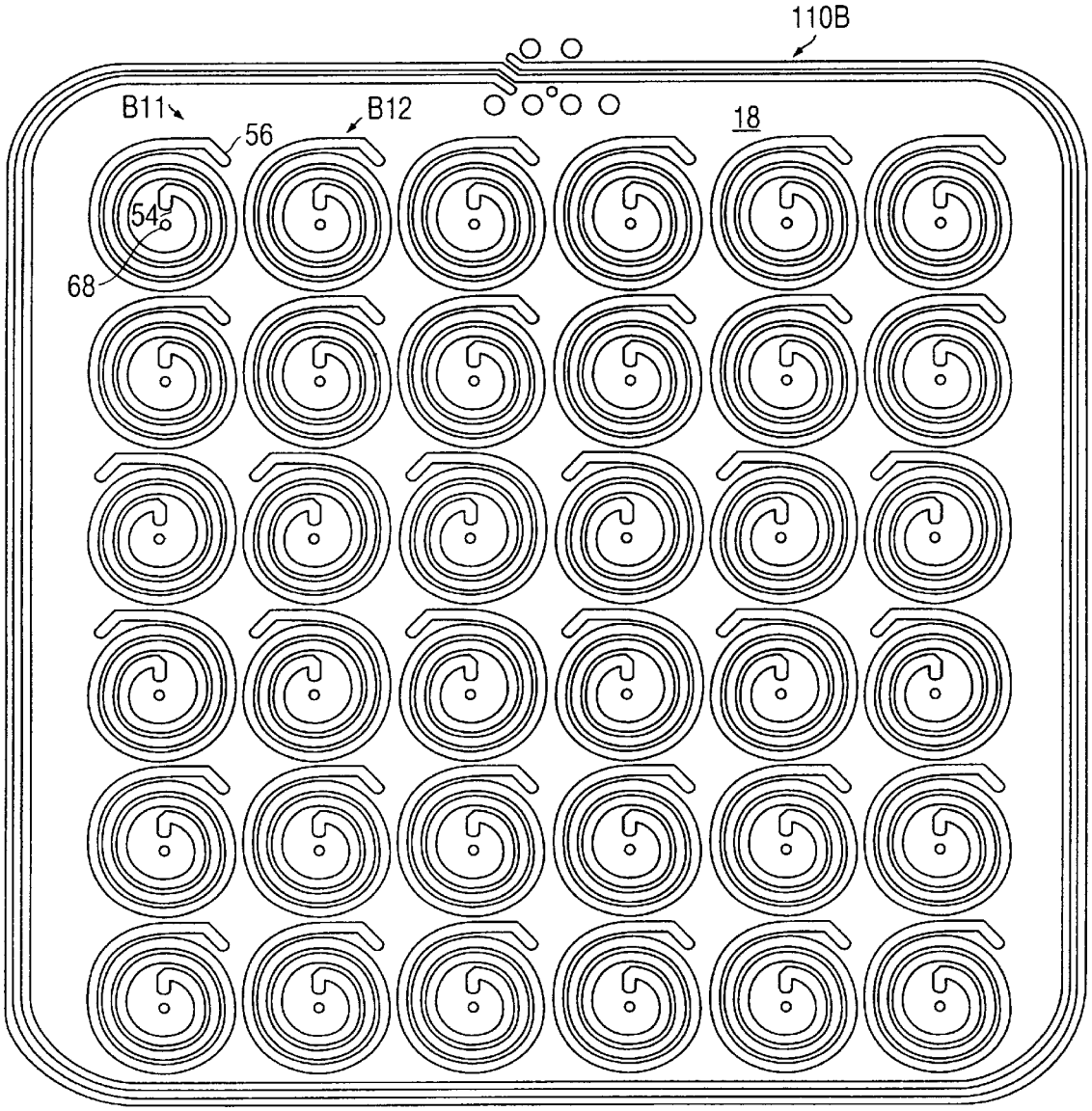
Figure 2C:
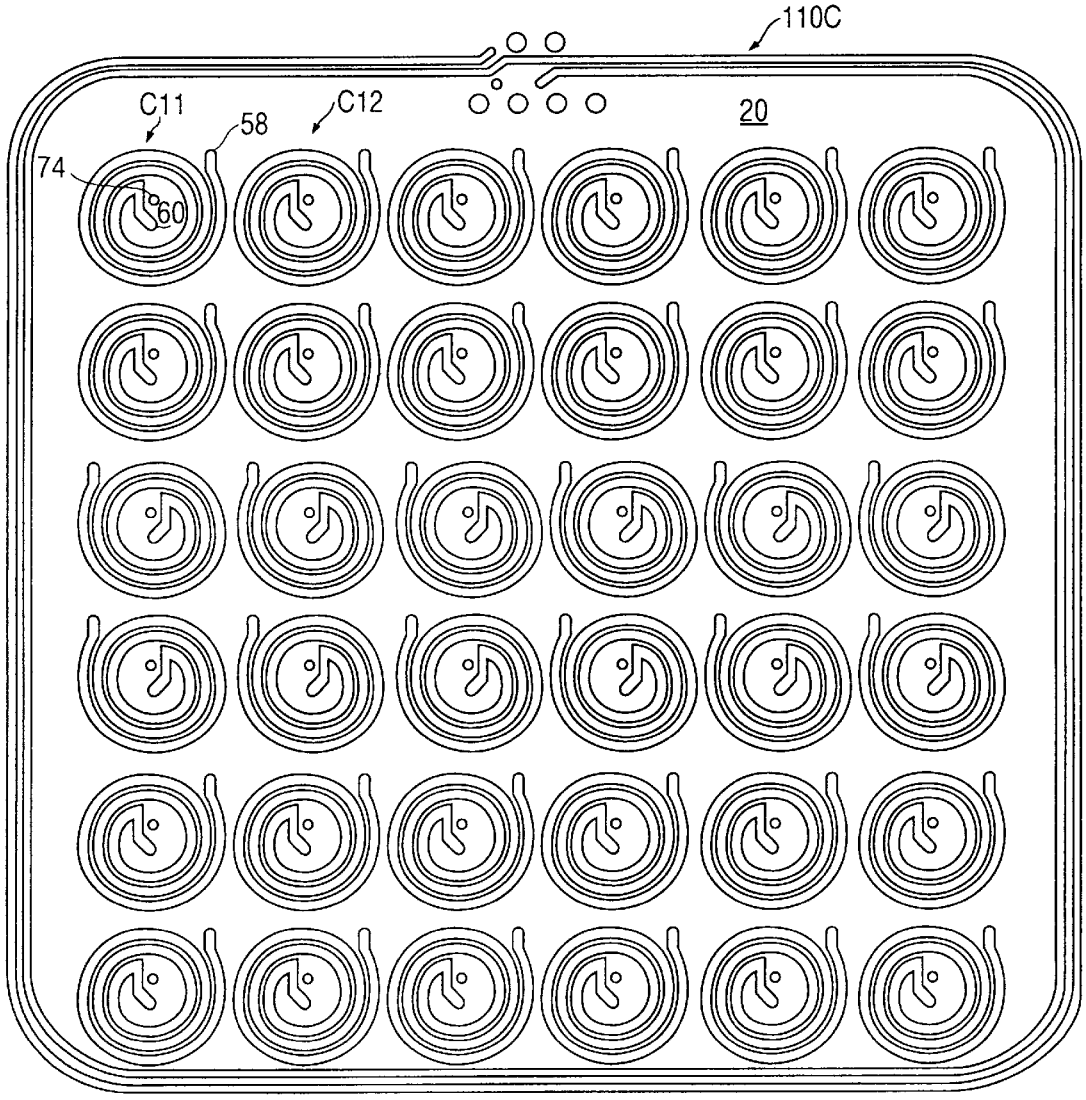
Figure 2D:
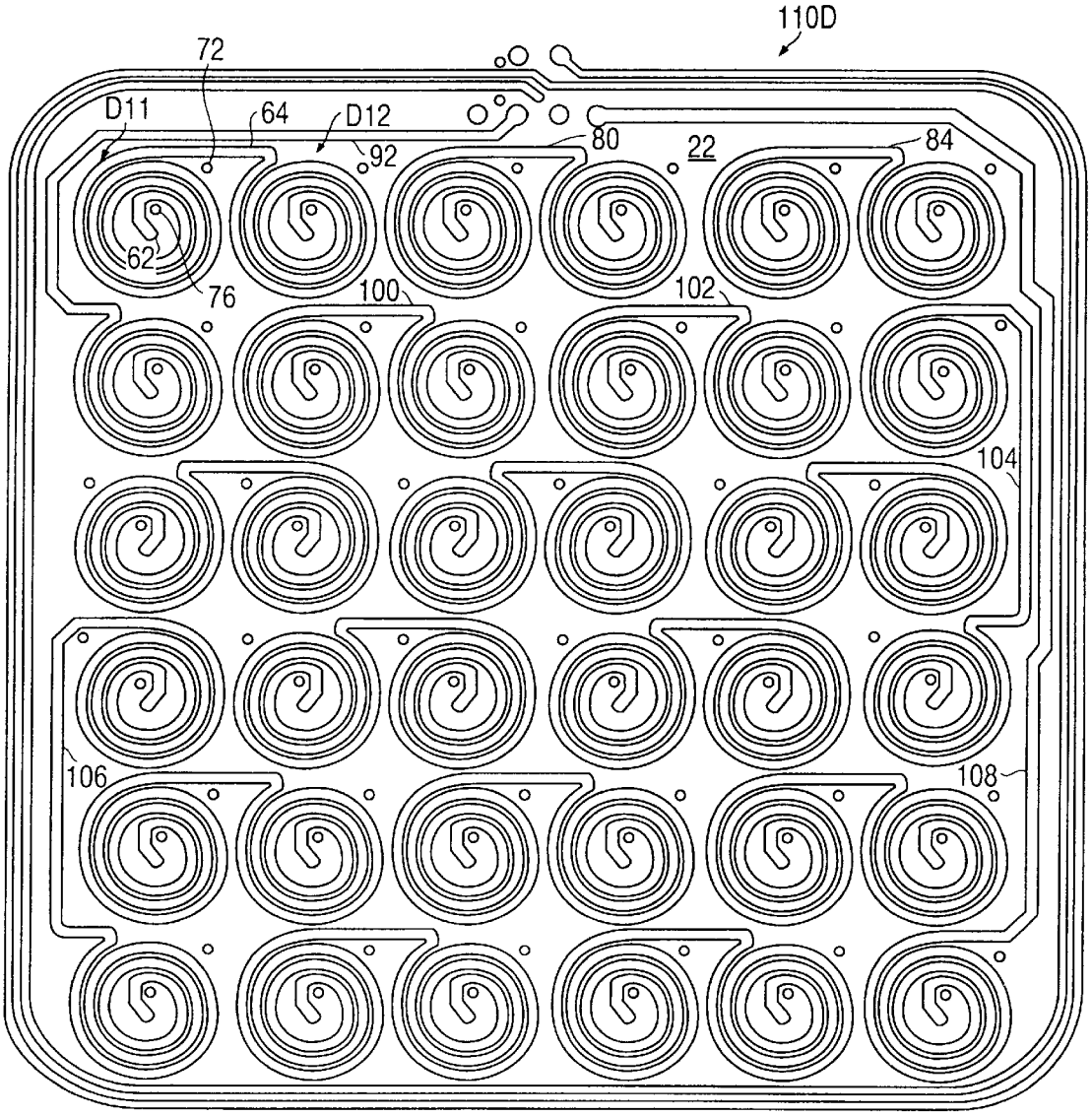

A first one of the two series coil arrangements is driven via a lead 50 (FIG. 2A) which is connected to the outermost turn of the upper-left-hand spiral coil A11 on substrate 16. A central terminal point 52 of coil A11 is conductively connected through a via hole (not shown) in substrate 16 to a central terminal point 54 of the upper-left-hand coil B11 on substrate 18 (FIG. 2B). A peripheral terminal point 56 of coil B11 is conductively connected through a via hole (not shown) in substrate 18 to peripheral terminal point 58 of corresponding coil C11 on substrate 20 (FIG. 2C). Further, a central terminal point 60 of coil C11 is conductively connected through a via hole (not shown) in substrate 20 to a central terminal point of coil D11 (FIG. 2D). Consequently, the super-posed coils A11, B11, C11 and D11 are series-connected to form one of the aforesaid composite coils.

It will further be noted that the series connection continues via a lead 64 which connects coil D11 to adjoining coil D12. A second composite coil arrangement is formed of super-posed coils D12, C12 (FIG. 2C), B12 (FIG. 2B) and A12 (FIG. 2A). In the same manner as just described, a series connection is made among these coils A12–D12 from either central or peripheral terminal points.

It is also to be noted that dots 66 (FIG. 2A) and 68 (FIG. 2B) correspond to via holes provided in registration on all the substrates to accommodate the connection between terminal points 60 (FIG. 2C) and 62 (FIG. 2D). Similarly, dots 70 and 72, on FIGS. 2A and 2D, respectively, correspond to the positions of via holes that allow connection between terminal points 56 and 58 on FIGS. 2B and 2C, respectively. Likewise, dots 74 and 76, respectively on FIGS. 2C and 2D, are indicative of the via holes to accommodate the connection between points 52 and 54 shown on FIGS. 2A and 2B, respectively.

The series connection maintained through the composite coils corresponding to coils A11, etc. and A12, etc. continues via leads 78 (FIG. 2A), 80 (FIG. 2D), 82 (FIG. 2A) and 84 (FIG. 2D), to link together all six of the composite coils corresponding to the first rows of the four coil arrays. The series connection is continued to the third rows of the coil arrays via a lead 86 shown on FIG. 2A and then to the six composite coils corresponding to the fifth rows of the coil arrays via a lead 88. The return from the first series connection, comprising the eighteen composite coils of the first, third and fifth rows, is provided via a lead 90.

The initial lead for the second series connection of 18 composite coils is indicated at 92 in FIG. 2D. In like manner to the previously-mentioned rows of composite coils, the composite coils of the second rows of the coil arrays are joined by leads 94, 96, 98 (FIG. 2A) and 100, 102 (FIG. 2D). The series connection continues from the composite coils of the second rows to the composite coils of the fourth rows by way of lead 104 shown on FIG. 2D. The series connection continues from the fourth rows to the sixth rows via lead 106 shown on FIG. 2D. The return path from the second series arrangement corresponding to the second, fourth and sixth rows of coils is provided by lead 108.

It will also be recognized from the nature of the connections described above that all of the individual spiral coils making up each composite coil are driven so that current flows in the same direction (i.e. all clockwise or all counter-clockwise). Moreover, each composite coil in a row is driven in the opposite sense from each adjoining coil or coils in the same row. Also, each coil is driven in the opposite sense from the corresponding coil in an adjacent row or rows. Thus, for example, the composite coil corresponding to spiral coil All in FIG. 2A, is driven in the opposite sense relative to the composite coil corresponding to coil A12. Furthermore, the composite coil corresponding to spiral coil A11 is driven in the opposite sense relative to the composite coil corresponding to spiral coil A21.

In a preferred embodiment of the invention, each of the substrates 16, 18, 20 and 22 is formed of a conventional material for printed circuit boards, such as fiberglass epoxy resin. All of the traces shown in FIGS. 2A–2D are preferably four-ounce copper, formed by deposition on the respective substrate and then etching away to provide the indicated pattern. For the spiral coils and leads referred to above, the track width is preferably 65 mils. The diameter of each of the spiral coils is, in a preferred embodiment, about 0.75 inch, corresponding to about one-half the length of the type of magnetomechanical EAS marker which the apparatus is designed to deactivate.

It should be understood that each of these parameters is subject to variation. Thus, the width and/or thickness of the copper traces may be changed, and the diameter of the spiral coils may be increased or decreased (although it is believed that a diameter of substantially one-half the length of the magnetomechanical marker to be deactivated is optimal). It is also contemplated to provide more or fewer than the four layers of spiral coil arrays shown herein. For example, only one layer (i.e. only one substrate) may be provided, with suitable connective traces being provided on the underside of the substrate. Conductive materials other than copper may be employed, and other types of substrate materials may be used. The number of composite coils may be less than or greater than the 36 shown, and the coil arrays need not be square. For example, non-square rectangular arrays are contemplated, as are triangular arrays and other shapes. Moreover, the number of turns in each spiral coil may be greater than or less than the three turns shown.

Another notable feature of the trace patterns shown in FIGS. 2A–2D is that each of the four square arrays of spiral coils is circumscribed by a two-turn coil, indicated, respectively, at 110A, 110B, 110C and 110D, in FIGS. 2A–2D. The coils 110A–110D are connected in series by means of via holes (not shown) in substrates 16, 18, 20 so that the four circumscribing coils together are connected to form a single, composite transceiver coil. The transceiver coil is connected by the above-referenced cable 30 (FIG. 1) to the detection circuit 28. The detection circuit 28 functions, in accordance with conventional practice, as a "doublecheck" circuit to determine whether markers presented for deactivation have in fact been deactivated. As is well-known to those who are skilled in the art, the "doublecheck" function consists of interrogating the markers by means of an energizing signal, and then detecting a ring-down signal generated by the marker in the case that the marker has not been properly deactivated. The transceiver coil is used to transmit the marker-energizing signal, and to pick up any resulting signal generated by the marker. If a still-active marker is detected, an audible and/or visible warning is given. The functioning and arrangement of the detection circuit 28 are conventional, and therefore will not be described further.

It is to be noted that the detection circuit 28 does not operate to trigger the coil driving circuit 24 but merely provides an indication when a marker presented for deactivation has not been properly deactivated. It is contemplated to omit from the deactivation device 10 either or both of the detection circuit 28 and the composite transceiver coil formed of the coil traces 110A–110D.

It is also contemplated to include in the deactivation device 10 a magnetic shield of stainless steel, pressed powdered iron, or the like. The shield would be positioned in the housing 12 below the coil array and would enhance the magnetic field generated by the coil array at positions above the housing.

Details of the coil driving circuit 24 will now be described with reference to FIG. 3, which is a schematic diagram of the circuit.

Figure 3A:
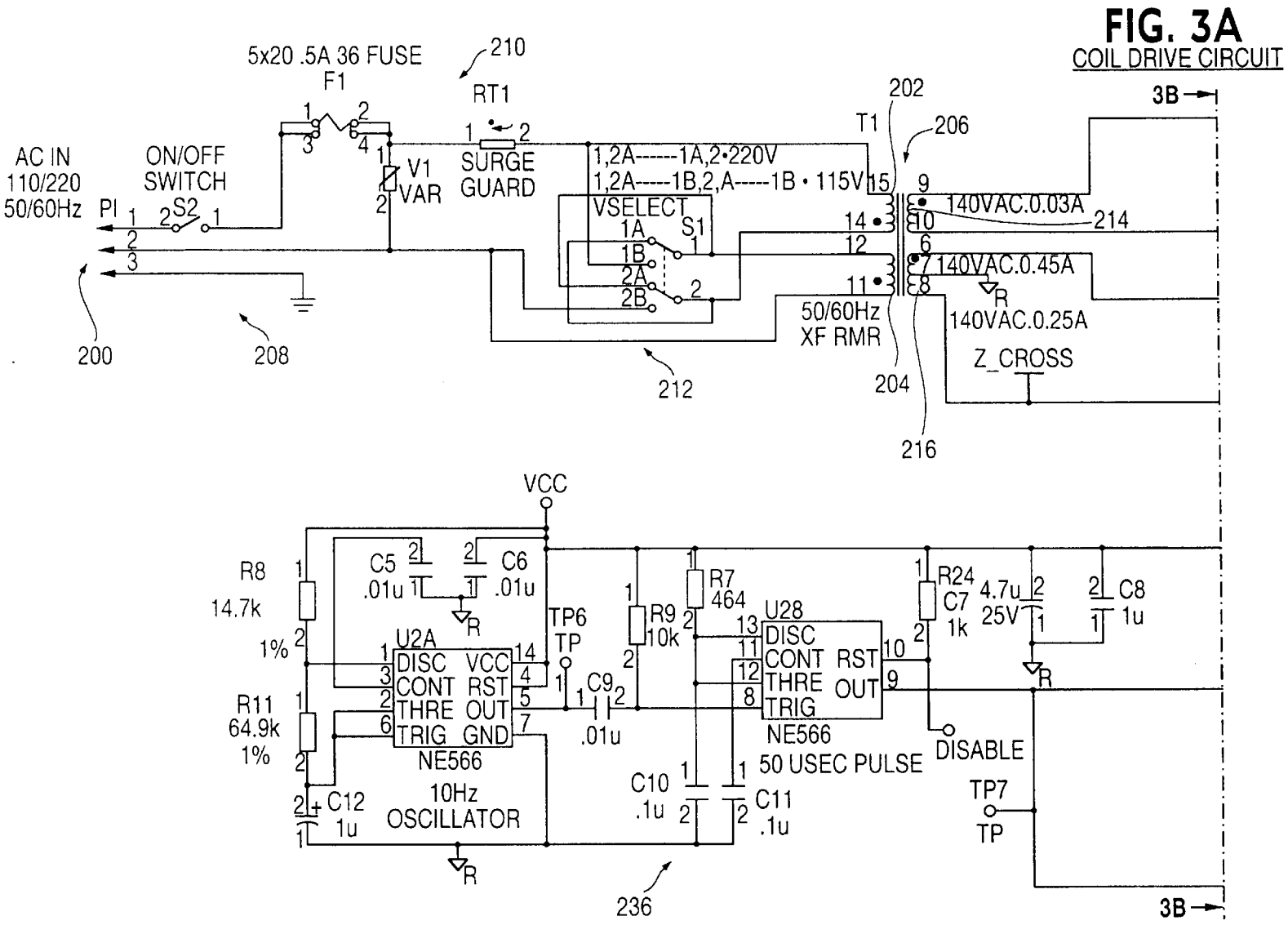
FIG. 3 is a schematic diagram of a coil driving circuit included in the deactivation device of FIG. 1.
Figure 3B:
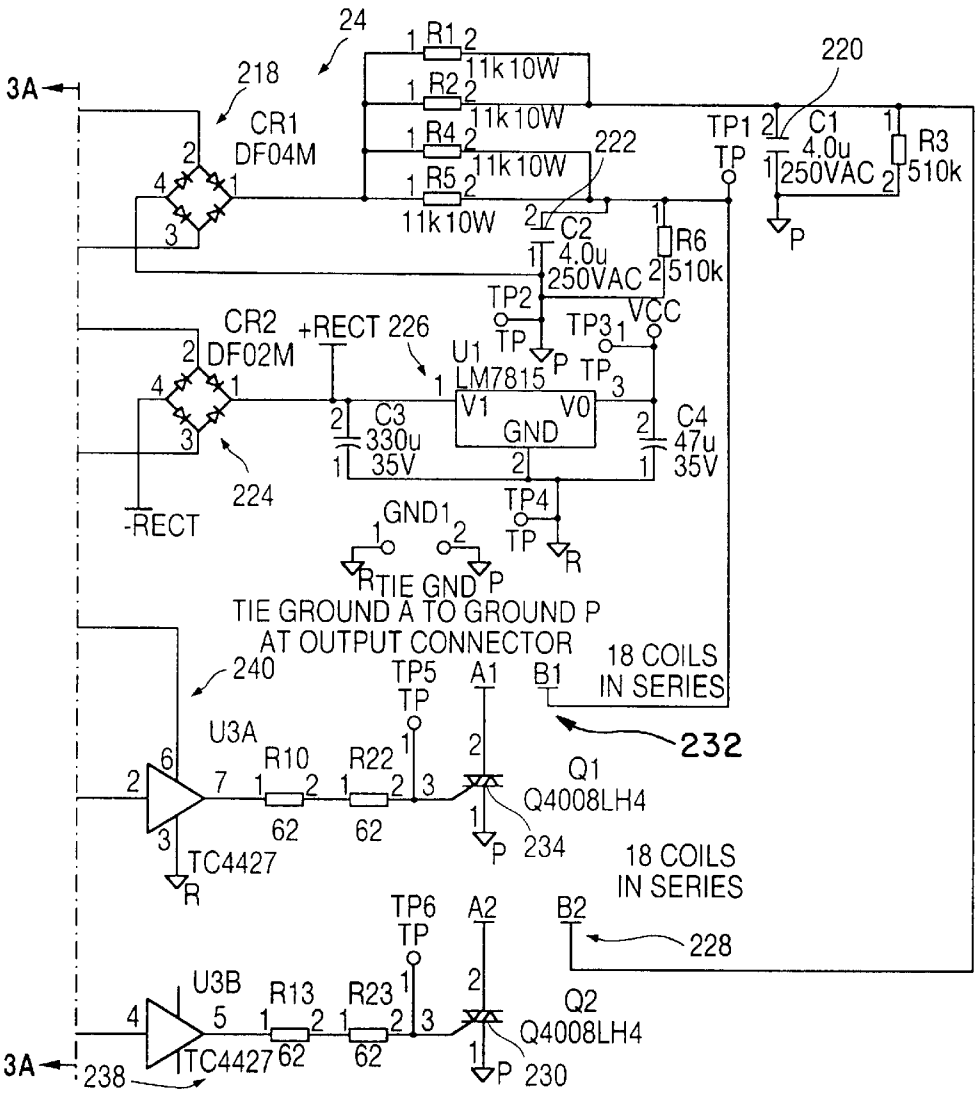

As seen from FIG. 3, a conventional AC power line signal provided at a terminal 200 is connected to primary windings 202, 204 of a transformer 206 by way of an on-off switch 208, conventional protective circuitry 210 and a switching arrangement 212. The switching arrangement 212 allows the coil driving circuit 24 to function either with 110 volt or 220 volt input power. A secondary winding 214 of the transformer 206 supplies the power signal after it has been stepped up or down, as the case may be, to a nominal level of 140 volts AC. This signal is rectified at diode bridge 218 and then applied, through appropriate connecting circuit elements, to charge storage capacitors 220, 222, which are connected in parallel to diode bridge 218 and in a manner to charge the capacitors to opposite polarities.

The other secondary winding 216 of the transformer 206 is connected, via a diode bridge 224, to logic power supply 226.

Storage capacitor 220 is connected to one of the two series arrangements of eighteen composite deactivation coils by one pole of terminal set 228. The other pole of the terminal set 228 connects that composite coil series arrangement to ground via triac 230. The other series arrangement of eighteen composite coils is connected to the other storage capacitor 222 by way of one pole of terminal set 232. The other pole of the terminal set 232 connects the second series arrangement of composite coils to ground via triac 234.

The coil driving circuit 24 is completed by timing circuitry 236 which controls the on and off states of the triacs 230 and 234 by means of triac drivers 238, 240, respectively.

It will be understood from FIG. 3 that when the triacs 230, 234 are in an open condition, the deactivation coil arrangements are essentially out of the circuit, and when the triacs are in a closed condition, each of the parallel deactivation coil arrangements forms a respective resonant circuit with its corresponding storage capacitor 220 or 222, to permit the charge on the storage capacitor to dissipate as a ring-down signal which energizes the respective deactivation coil arrangement. The energized coils generate a declining-amplitude alternating magnetic field at and above the top surface of the deactivation device 10.

Figure 4:
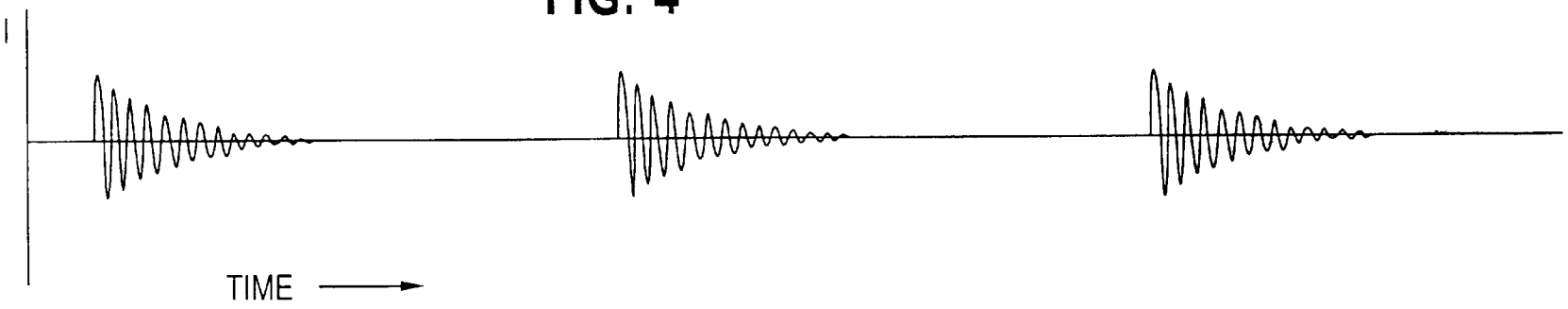
FIG. 4 illustrates a current waveform of the signal applied to the coil arrays by the coil driving circuit of FIG. 3.

In operation, the timing circuit 236 and drivers 238, 240 cause both triacs 230, 234 to be closed simultaneously and then opened simultaneously at a predetermined timing. The resulting current waveform induced in both of the deactivation coil arrangements is shown in FIG. 4. It will be noted that the waveform is a sequence of isolated ring-down pulses, separated by intervals during which the triacs are in an open state and the deactivation coils are not driven. (For purposes of illustration, the time scale of the ring-down signal pulses is exaggerated relative to the intervening periods when no drive signal is applied, and the number of cycles within each pulse is also exaggerated.) According to a preferred embodiment of the invention, the repetition rate of the ring-down signal pulses is substantially 10 Hz, the ringing frequency is about 12 Khz, and the duration of each pulse (time to decay to substantially zero amplitude) is about 300 microseconds. Given the repetition rate of 10 Hz, it will be understood that the ring-down signal pulses are commenced at regular intervals of one-tenth second.

It will be noted from FIG. 3 that the capacitors 220, 222 are constantly being charged. The repetition rate of the coil driving signal, the voltage provided by the secondary winding 214, and the component values are selected so that, at the time each driving signal pulse begins, the capacitor is charged at least to an adequate level to provide a deactivation field of sufficient amplitude to deactivate markers presented within a predetermined distance of the top of the deactivation device. The maximum charge applied to the capacitors 220, 222 is limited by the peak voltage supplied through secondary winding 214. Because the minimum charge to the capacitor is determined by the timing at which the triacs are closed, and the maximum is limited by the charging signal level, no voltage regulator is required.

It has been noted above that the nominal output of the secondary winding 214 is 140V AC. Because the actual input AC power may vary from the nominal 110V or 220V, the actual signal level applied to diode bridge 218 may be in the range 120 to 160V (RMS), and the maximum DC level applied to the capacitors 220, 222, and hence the maximum charge level of the capacitors, may be about 180 to 230 V.

Because of the relatively rapid repetition rate of the deactivation signal pulses, a magnetomechanical EAS marker presented at the top surface of the deactivation device is likely to be subjected to at least several ring-down signal pulses, thereby providing highly reliable operation. There is no requirement either for triggering by the operator or for providing detection circuitry to initiate a deactivation signal pulse. Contrary to what would be expected by those of ordinary skill in the art, the coil arrangement and driving circuit disclosed herein operate together so that overall power consumption is relatively low, notwithstanding the continuously repetitive operation of the device. Also contrary to what would be expected by those of ordinary skill, the driving circuit shown in FIG. 3 can be implemented in a compact package on a single printed circuit board. In fact, the inventors have arranged both the driving circuit and the above-mentioned detection circuit together on a single 5 in.×6 in. board.

Although the driving circuit of FIG. 3 has been optimized to drive the coil array described in connection with FIGS. 2A–2D, the driving circuit may readily be adapted for use with many other types of deactivation coil arrangement. One such alternative coil arrangement is that shown in the "bulk" deactivation device disclosed in U.S. Pat. No. 5,781,111, which has a common inventor and a common assignee with the present invention.

The timing circuit 236 could be modified such that only one of the triacs is in a closed condition at a given time, in which the case the driving circuit would be suitable for use with the core-wound deactivation coil arrangements shown in co-pending application Ser. No. 09/016,175, filed Jan. 30, 1998. Other deactivation coil arrangements with which the driving circuit of the present invention may be used are disclosed in co-pending applications Ser. Nos. 08/801,489, filed Feb. 18, 1997; and 08/794,012, filed Feb. 3, 1997.

The deactivation coil arrangement described herein includes two series connections of coils, driven in parallel by respective storage capacitors, to reduce the resistance and therefore to increase the Q of the resulting resonant circuits. However, it is contemplated to use the driving circuit with only one coil, or to provide all the deactivation coils in the deactivation device in series with each other, in which case only one storage capacitor and one triac would be required. Alternatively, it is also contemplated to modify the driving circuit to operate with three or more parallel-connected coils or coil-series.

The coil driving circuit shown herein charges the storage capacitors from a direct current derived from an AC power signal. However, other arrangements may be used to charge the capacitors, included a battery, for example. It should also be understood that each of the storage capacitors may be replaced with a capacitor bank.

Instead of the triacs shown herein, other types of switching devices, such as MOSFET's may be used.

Various other changes in the foregoing apparatus may be introduced without departing from the invention. The particularly preferred embodiments of the invention are thus intended in an illustrative and not limiting sense. The true spirit and scope of the invention are set forth in the following claims.

What is claimed is:

1. Apparatus for deactivating an electronic article surveillance marker, the apparatus comprising:

at least one deactivation coil; and a driving circuit for repetitively energizing said at least one deactivation coil according to a predetermined timing to generate a magnetic field for deactivating said marker, the driving circuit including:

at least one storage capacitor;

means for charging said at least one storage capacitor;

ring-down means for selectively forming a resonant circuit which includes said at least one deactivation coil and said at least one storage capacitor, to generate a ring-down signal in said at least one deactivation coil; and timing means for controlling said ring-down means to generate said ring-down signal repetitively at said predetermined timing.

2. Apparatus according to claim 1, wherein said ring-down means includes switching means.

3. Apparatus according to claim 2, wherein said switching means includes at least one triac.

4. Apparatus according to claim 1, wherein said at least one deactivation coil includes a plurality of deactivation coils.

5. Apparatus according to claim 4, wherein said plurality of deactivation coils includes two coils connected in parallel to said driving circuit.

6. Apparatus according to claim 5, wherein said at least one storage capacitor includes two storage capacitors connected in parallel to said means for charging.

7. Apparatus according to claim 6, wherein each of said storage capacitors is connected to a respective one of said two coils.

8. Apparatus according to claim 7, wherein said plurality of deactivation coils includes a first series arrangement of coils connected to a first one of said storage capacitors and a second series arrangement of coils connected to a second one of said storage capacitors.

9. A method of deactivating a magnetomechanical EAS marker, the method comprising the steps of:

providing a deactivation coil;

repetitively energizing the deactivation coil with a ring-down pulse signal at a predetermined timing to form an alternating magnetic field; and positioning the magnetomechanical EAS marker in said alternating magnetic field formed during said repetitive energizing of said coil, to deactivate the marker.

10. A method according to claim 9, wherein said step of repetitively energizing the deactivation coil includes selectively forming a resonant circuit which includes the deactivation coil and a charged storage capacitor.

11. Apparatus for deactivating an electronic article surveillance marker, the apparatus comprising:

a source of an AC power signal;

a transformer which includes a primary winding connected to said power signal source, and a secondary winding;

a diode bridge connected to said secondary winding for rectifying an AC signal in said secondary winding;

first and second storage capacitors connected to said diode bridge so as to be charged by said rectified signal;

a first deactivation coil arrangement connected to said first storage capacitor;

a second deactivation coil arrangement connected to said second storage capacitor;

a first triac connected between said first deactivation coil and ground;

a second triac connected between said second deactivation coil and ground; and a timing circuit for selectively placing said triacs in a closed condition at regular intervals to repetitively drive said deactivation coils with a ring-down signal.

12. Apparatus according to claim 11, wherein said storage capacitors are continuously connected to receive said rectified signal.

13. Apparatus according to claim 11, wherein said regular intervals are each substantially one-tenth second.

* * * * *